US007731071B2

(12) United States Patent
Melgaard et al.

(10) Patent No.: US 7,731,071 B2
(45) Date of Patent: Jun. 8, 2010

(54) STAPLE LEG GUIDE

(75) Inventors: Brian E. Melgaard, Boonton, NJ (US); Joel S. Marks, Sherman Oaks, CA (US); Warren Yan, New York, NY (US)

(73) Assignee: Accentra, Inc., Newtown, PA (US)

( * ) Notice: Subject to any disclaimer, the term of this patent is extended or adjusted under 35 U.S.C. 154(b) by 159 days.

(21) Appl. No.: 12/192,079

(22) Filed: Aug. 14, 2008

(65) Prior Publication Data

US 2009/0045238 A1 Feb. 19, 2009

Related U.S. Application Data

(60) Provisional application No. 60/956,211, filed on Aug. 16, 2007.

(51) Int. Cl.
*B25C 5/00* (2006.01)

(52) U.S. Cl. ..... 227/139; 227/120; 227/135; 227/146; 227/148

(58) Field of Classification Search ..... 227/139, 227/120, 135, 146, 148, 149
See application file for complete search history.

(56) References Cited

U.S. PATENT DOCUMENTS 3,263,888 A * 8/1966 Wandel ..... 227/132
3,347,439 A * 10/1967 Doherty ..... 227/109
3,348,752 A * 10/1967 Wheble ..... 227/109
3,583,622 A * 6/1971 Graeff ..... 227/120
3,958,738 A * 5/1976 Tremblay ..... 227/109
4,109,844 A * 8/1978 Becht ..... 227/120
4,151,944 A * 5/1979 Picton ..... 227/120
4,598,852 A * 7/1986 Olesen ..... 227/119
4,662,555 A * 5/1987 Thornton ..... 227/19
4,671,445 A 6/1987 Barker et al.
4,763,824 A 8/1988 Ebihara
5,511,716 A 4/1996 Marks
5,735,444 A * 4/1998 Wingert ..... 227/120
6,257,477 B1 7/2001 Straat et al.
6,776,321 B2 8/2004 Jairam et al.
7,118,019 B2 * 10/2006 Marks ..... 227/119
2006/0163308 A1 7/2006 Kitamura et al.
2008/0156844 A1 * 7/2008 Braganza et al. ..... 227/109

OTHER PUBLICATIONS

International Search Report issued Nov. 10, 2008, pp. 1-2.

* cited by examiner

*Primary Examiner*—Brian D Nash
(74) *Attorney, Agent, or Firm*—Paul Y. Feng; Fulwider Patton LLP

(57) ABSTRACT

A staple leg guide for use with desktop staplers having a channel shape, with two downward extending fingers that support the underside of the staple legs as the staple is driven into a stack of sheet media to reduce kinking and improper penetration of the stack by the staple leg.

16 Claims, 11 Drawing Sheets

STAPLE LEG GUIDE

CROSS-REFERENCE TO RELATED APPLICATIONS

This application claims priority from U.S. Provisional Application No. 60/956,211, filed Aug. 16, 2007, whose contents are hereby incorporated by reference in their entirety.

BACKGROUND

As a common staple is driven from a rack of staples in a desktop stapler, the legs of the staple can become bent or curled from contacting the paper stack in a non-perpendicular manner. One leg can become angled inward due to a lack of support along the interior of the staple legs. The exterior of the staple legs, however, is supported typically by the housing walls of the staple chamber that prevent the legs from accidentally flaring outward before the points of the leg penetrate the surface of the paper stack.

If a staple leg bends inward prior to penetrating the surface of the paper stack, as the staple is driven through the paper, the leg that is bent inward cannot support the forces on top of the staple, which can cause the staple, the staple leg, or both to buckle, or the leg may be pinched inward. This can result in poor or non-existent clinching of the paper stack by that staple. On the other hand, once the staple legs have penetrated the top surface of the paper stack, the legs are thereby stabilized by the paper and the legs can continue to pass straight through the paper stack and into the anvil underneath for a normal clinched configuration.

Some conventional, non-spring energized desktop staplers have a track design that supports the interior and exterior of the staple legs. Typically, an inner staple track is connected to an outer staple track using a very strong and stiff spring that holds the inner track under the staple as the staple is driven into the paper stack. The staple, as it is driven, forces the inner track rearward away from the staple path and allows the staple to be driven into the stack of paper. The staple guide feature is incorporated into the front end of the inner track and the inner and outer tracks move in unison as the staple is driven into the paper stack.

In the conventional design, the staple leg guide/inner track is forced rearward away from the staple being driven as soon as that staple is sheared from the rack, but before the staple leg points have penetrated the surface of the paper stack. As a result, there needs to be a very large biasing force against the inner track, urging it toward the driven staple. If there is only a small biasing force, the inner track can be moved rearward from the momentum generated by the impact with the driven staple, which again occurs before the staple points have penetrated the paper. Conventional designs that suggest a large biasing force on the inner track urging it toward the driven staple in order to resist this rearward momentum and to maintain the staple leg guide/inner track in position to guide the staple legs perpendicularly into the paper stack.

An example of a staple guide is disclosed in U.S. Pat. No. 4,151,944 (Picton). Picton teaches a "shoe" that is designed to guide the interior of the legs of a staple.

SUMMARY OF THE INVENTION

A staple track for supplying a rack of staples in a desktop stapler used to bind a stack of papers with a staple having two legs, comprising a staple track channel having a width that substantially matches the width between the two legs of the staple and having a length to support the rack of staples thereon and having a striker front end and a back end, wherein the channel includes side wall cutouts at the striker end; a staple pusher disposed on the channel and biased away from the back end of the channel toward the striker end to push the staples supported on the channel; a staple leg guide disposed to move independent from the channel and biased toward the striker end, wherein the staple leg guide includes two fingers that extend outside of the channel through the side wall openings so that the fingers are spaced apart to substantially the same width of the channel, and the fingers traverse toward and away from the striker end; and a spring biasing the staple leg guide toward the striker end; whereby the two fingers guide the two staple legs into the paper stack.

BRIEF DESCRIPTION OF THE DRAWINGS

FIG. 2A shows the guide relative to the staple just prior to the striker driving the staple, the middle row FIG. 2B shows the guide after the staple has been ejected, and the bottom row FIG. 2C shows the staple pusher removed.

DETAILED DESCRIPTION OF THE PREFERRED EMBODIMENTS

The present invention in one embodiment incorporates a staple leg guide for the interior of the staple legs to prevent the legs from bending inward until the staple points are able to penetrate at least the surface of the stack of papers to be bound. Once the points of the staple have penetrated the paper surface, the guide is no longer needed to support the staple legs since the ends of the staple are now constrained and stabilized by the paper. At this moment, the staple leg guide is cleared from the path of the staple so that the staple can continue to be driven into the stack of sheet media or papers. The increase in actuation force as measured from the handle in the present invention staple leg guide equipped stapler is very minute, and is a dramatic improvement over conventional staple leg guides that require the handle actuation force to be very high. The very high handle actuation force means that the user must apply greater pressure on the handle to actuate or fire the stapler.

The present invention staple leg guide is preferably incorporated into a staple track of a spring-powered or energized desktop stapler, such as that shown in, for example, U.S. Pat.

No. 6,918,525 (Marks); U.S. Pat. No. 7,080,768 (Marks); U.S. Pat. No. 7,216,791 (Marks); and U.S. Patent Application Publication No. US 2007/0175946 (Marks), all of whose contents are hereby incorporated by reference. The staplers are used to bind a stack of sheet media such as papers, or to tack a poster to a bulletin board.

Figure 1:
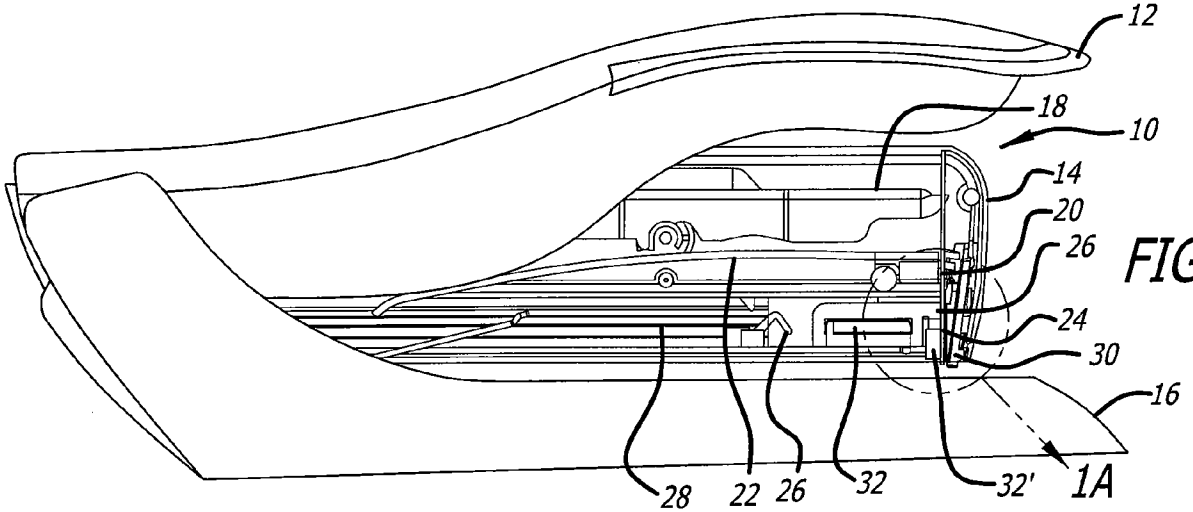
FIG. 1 is a side elevational view of a spring powered desktop stapler with a cutaway view of the stapler body.

FIG. 1 is a side elevational view of an exemplary spring-powered or energized desktop stapler 10 with a partial cross-sectional view of the stapler body 14 or housing enclosing the internal mechanical structures. The stapler 10 has a handle 12 pivoted at the back end. The body 14 is disposed above a base 16. Contained within the body 14 is a lever 18 that is pivoted and actuated by the handle 12. The front end of the lever 18 is linked to a striker 20. A flat power spring 22 is also linked to the striker 20 so that as the handle 12 is pressed, the power spring 22 is energized to store potential energy that can accelerated the striker 20 downward into the staple 24 beneath. With sufficient handle movement, the front end of the lever 18 de-links from the striker 20, which releases the striker 20 to be freely accelerated into the staple 24 thus ejecting it out of the body 14 by impact blow. An anvil is embedded into the base 16, and a paper stack (FIG. 1A) rests over the anvil on the base 16, so the ejected staple 24 pierces the paper stack via its legs 34. The anvil curls the legs 34 around the back of the paper stack thus clinching and binding the paper stack tightly together.

Figure 1A:
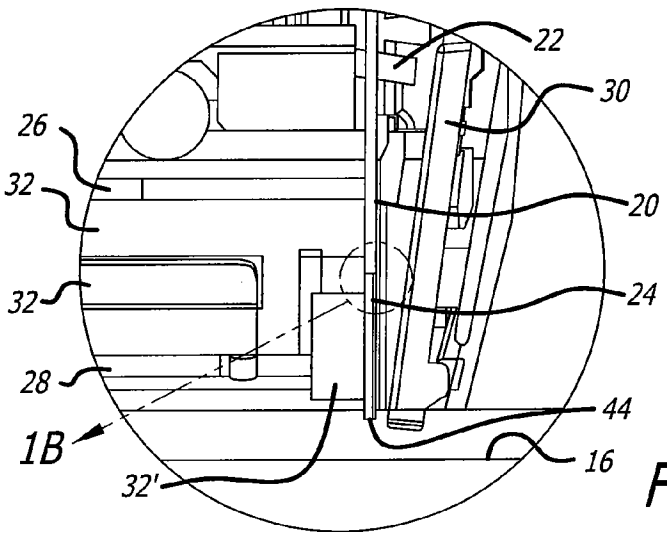
FIG. 1A is a detailed view of region A of FIG. 1 showing the striker, staple, and staple leg guide.
Figure 1B:
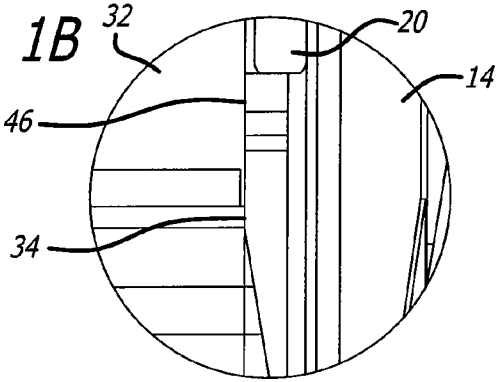
FIG. 1B is a detailed view of region B of FIG. 1A showing the staple leg and cross-member.

FIG. 1A is an enlarged detail view of region A of FIG. 1, and FIG. 1B is an enlarged detail view of region B in FIG. 1A. The front-most staple 24 is part of a rack of staples, wherein the rack is pushed forward by staple pusher 26, which itself is urged toward the front of the stapler 10 by a spring. The rack of staples rests and slides on a staple track 28 having a U-channel body that extends along the bottom and length of the stapler body 14. A safety mechanism 30 operates at the very front end of the body 14. The safety mechanism 30 prevents the accidental firing of the stapler 10 when the base 16 has been pivoted away from the staple exit port and the stapler is not being used as a tacker.

Figure 2A:
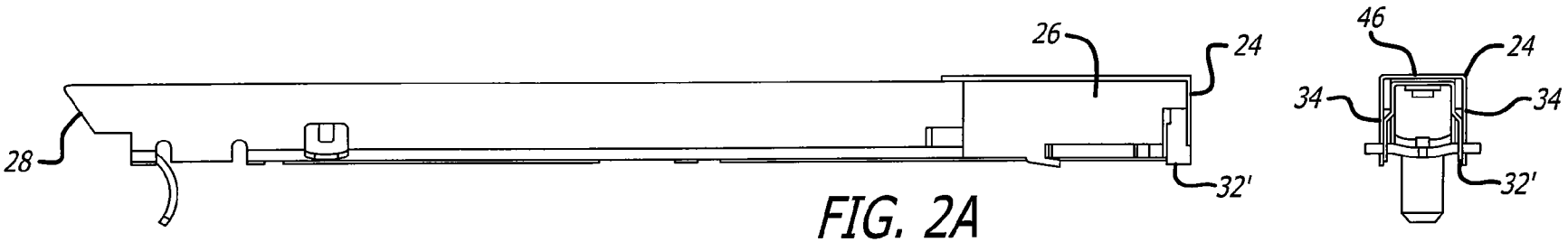
FIGS. 2A, 2B, 2C include side elevational views and end views of the staple track, wherein the top row
Figure 2B:
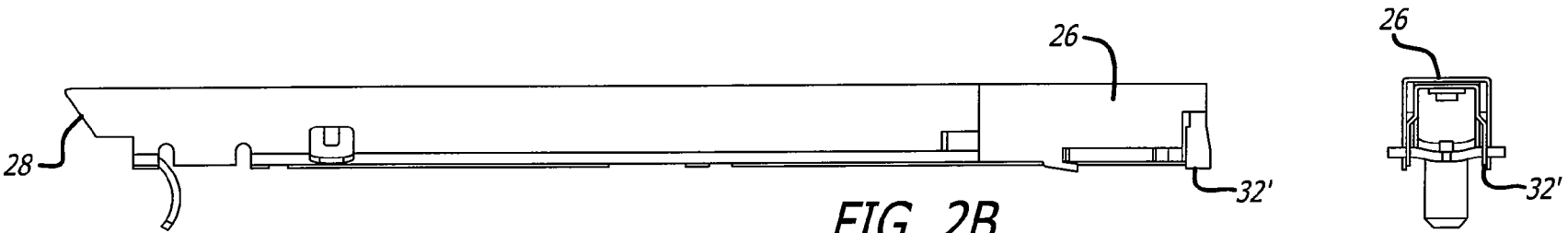
Figure 2C:
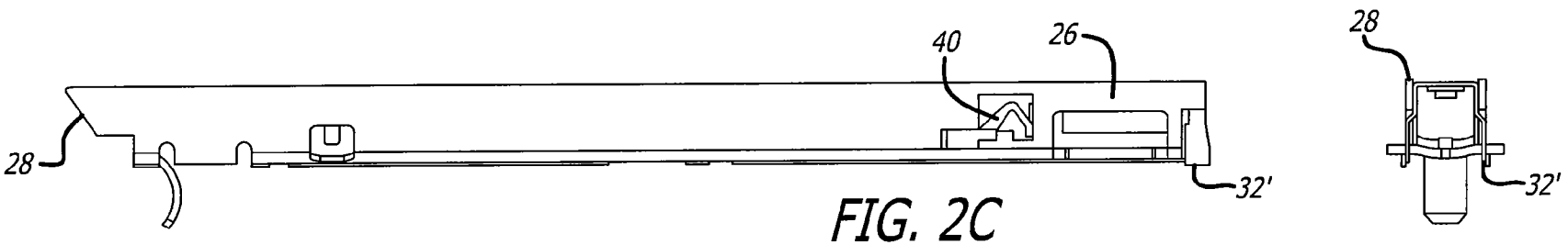

FIGS. 2A, 2B, and 2C are side elevational views and front end views of the staple track 28, wherein the top row FIG. 2A shows a staple leg guide 32 relative to the front-most staple 24 just prior to the striker 20 driving the staple 24; the middle row FIG. 2B shows the guide 32 after the staple 24 has been ejected; and the bottom row FIG. 2C shows the staple pusher 26 removed. The spring-driven staple pusher 26 and staple rack (not shown) traverse along the top of the staple track 28 where the staple pusher 26 urges the staples toward the front, striker end (away from the back end) of the staple track 28 to situate the front-most staple 24 directly over the staple leg guide 32 as seen in FIG. 2A.

Figure 4A:
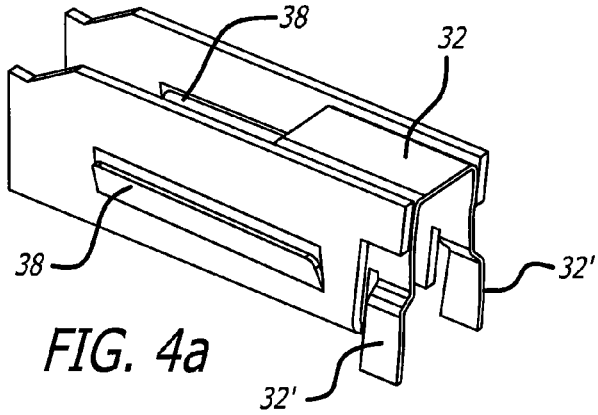
FIGS. 4(*a*)-(*c*) are various views of the staple leg guide.
Figure 4B:
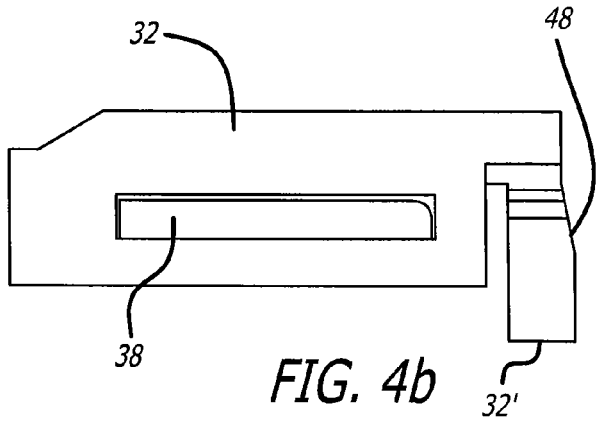
Figure 4C:
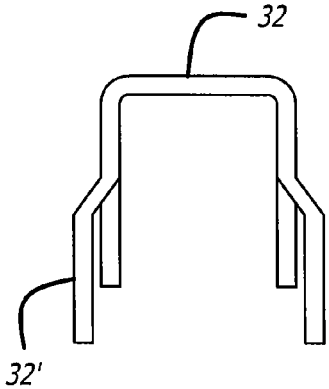

In a preferred embodiment, the present invention staple leg guide 32 shown in FIGS. 2A-2C, 4(*a*)-(*c*) has a U-channel shape body that is a discrete part that is separate from the staple track 28. That is, the preferred embodiment U-channel shape staple leg guide 32 mounts inside the staple track U-channel (front end view FIG. 2C) and moves separately and independently from the staple track 28. The preferred embodiment staple leg guide 32 shown in FIG. 4(*c*) has a channel body with a top overhang joining a portion of the two walls of the channel, and two fingers 32' at the front end of the guide 32 that appear similar to fins, as seen in FIG. 4(*a*). In FIG. 4(*a*), a rectangular area, partially cut out of the wall of the channel is bent outward forming a tab 38. There is one tab 38 on each side of the guide 32.

In FIGS. 2A-2C, the staple pusher 26 slides along the top of the staple track 28 and the staple leg guide 32 of FIG. 4 is positioned inside the staple track 28. In the front end views of FIGS. 2A-2C, it can be seen that the staple legs straddle the width of the staple track 28 and the staple leg guide 32. Specifically, the pair of downward extending, fin-like fingers 32' of the staple leg guide 32 are spaced apart and support the respective staple legs 34 from in between or underneath.

Figure 5:
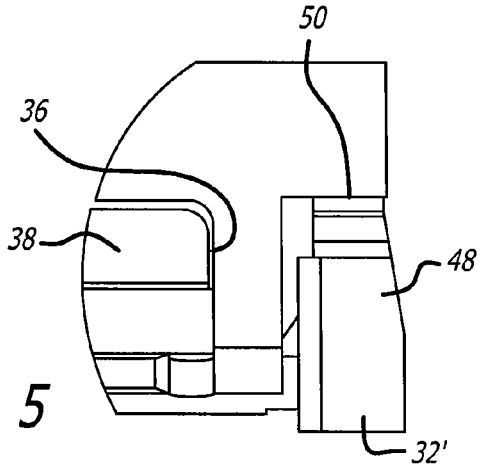
FIG. 5 is a detailed view of region C of FIG. 2C at the front end of the track.

FIG. 5 is a magnified, detailed view of region C of the staple track 28 in FIG. 2B. As depicted in these drawings, two rectangular shaped windows 36, one in each side wall of the staple track 28, allow a portion—i.e., tabs 38 of FIG. 4—of the staple leg guide 32 to protrude therethrough. The staple leg guide 32 is biased toward the striker front end of the staple track 28 by a guide spring 40 shown in the different views of FIG. 3. The guide spring 40 preferably has a U-channel shape with a pair of arched legs 42 providing the compliance. The U-channel shape enables compact and efficient fitment inside the staple track 28 as seen in FIG. 2C. Another spring (not shown) biases the staple pusher 26 toward the front end of the staple track 28, thereby urging or feeding a rack of staples in that same direction.

The preferred embodiment design enables the staple leg points 44 (FIG. 1A) to penetrate the paper stack before the fingers 32' of the staple leg guide 32 are pushed rearward and out of the path of the staple 24 being driven into the paper stack. This is depicted in detail A of FIG. 1A and detail B of FIG. 1B. Specifically, in FIG. 1A, the driven staple's legs 34 move past the staple leg guide fingers 32' and the staple leg points 44 begin to pierce the paper stack. This is possible because the guide 32 does not protrude under the driven staple 24 for a distance equal to or greater than the distance between the bottom of the staple 24 and the surface of the paper stack.

As the staple 24 continues along its path being driven downward into the paper stack, the cross-member 46 (FIG. 1B) joining the two staple legs 34 moves into contact with the sloped or angled leading edge of each finger 32' (FIGS. 4(*b*), 5) of the staple leg guide 32. The pressure from the moving cross-member 46 of the driven staple 24 pushes the fingers 32' and the entire guide 32 slides backward out of the path of the ejecting staple 24 and the striker 20. Since the staple leg points 44 are already embedded in the stack of paper, the guide 32 is moved rearward quickly and instantly by the driven staple 24. Staples are thus supported from between the legs 34 and can be reliably and repeatably driven into the paper stack.

Figure 3A:
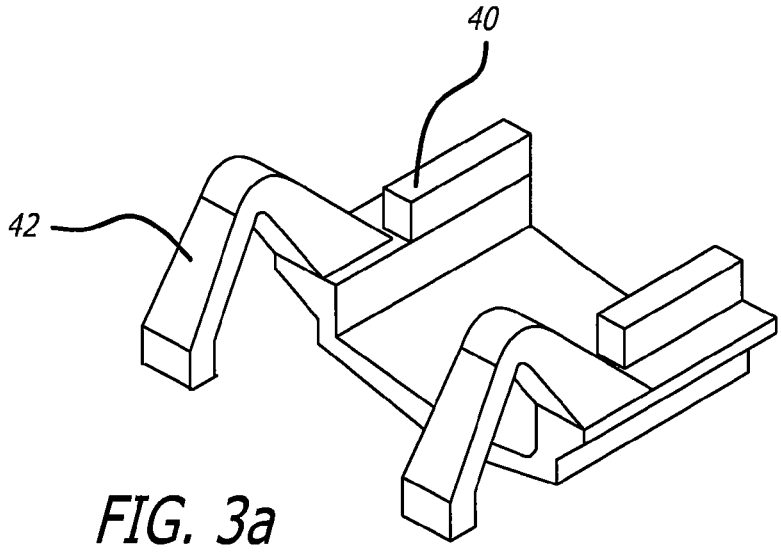
FIGS. 3(*a*)-(*c*) are various views of the staple leg guide spring.
Figure 3B:
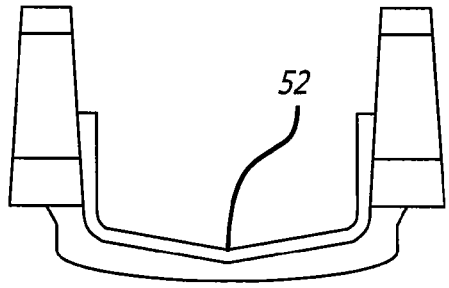
Figure 3C:
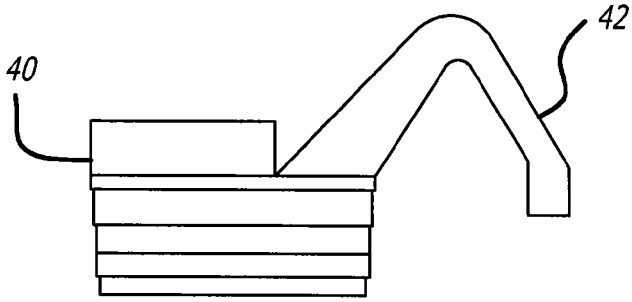

The independent movement and U-channel design of the staple leg guide 32 within the U-channel forming the staple track 28, and optionally, the staple pusher 26, enable the use of a very light guide spring 40 (FIG. 3(*a*)-(*c*)) to reset the guide 32 to its initial position underneath the driven staple (FIG. 5). Further, the part acting as the staple leg guide 32 in the preferred embodiment is small in size, thin walls, and low mass; it thus moves with less momentum and inertia as compared to a conventionally large and heavy staple leg guide for a given velocity. The low momentum of the staple leg guide 32 also lends itself to operate well with very light guide reset spring 40. This is a very significant advantage since a light (i.e., low spring rate k of legs 42) reset spring 40 adds very little force to be overcome by the staple 24 being driven by the striker 20.

That is, during the driving cycle or motion of the striker 20, the striker 20 and/or the staple 24 press the staple leg guide 32 rearward out of the path of the staple. The less force required to move the guide 32 the better, as it leaves more energy available to drive the staple into the paper stack. If more energy is available to drive or propel the staple 24 rather than used to move the guide 32, the staple 24 is more likely to penetrate a thicker stack of papers. Therefore, a very low force biasing reset spring 40 acting on the staple leg guide 32 is preferred and leads to superior performance of the entire system. This major benefit applies to inertia-based direct drive staplers or to spring-powered staplers.

A smaller force acting on the striker 20 via the staple leg guide reset spring 40 is also advantageous in, for example, a low-start or a high-start spring-powered stapler. In a low-start stapler design, the staple leg guide 32 presses against the striker 20 when the stapler is in a rest position. As the striker 20 is raised (as the handle 12 is pressed), the staple leg guide 32 presses against the striker 20. This contact and the force of the reset spring 40 biasing the guide 32 forward toward the striker end add friction to the system, which must be overcome by the handle pressure applied by the user during the pressing stroke. As a result, the higher, friction-created handle actuation forces give an undesirable feel for the user and requires greater effort by the user to operate or fire the stapler.

In a high-start stapler, in the reset cycle, the guide presses against the striker which is resetting upwards to its initial high-start position. The guide 32 pressing against the striker 20 adds undesirable friction that puts unwanted drag on the striker's motion. The added friction needs to be overcome by a more powerful (i.e., stiffer or higher spring rate k) striker reset spring. The more powerful striker reset spring adds to the handle pressing force, since as the handle 12 is pressed to actuate the stapler, it must overcome the more powerful striker reset spring force too. This leads to undesirable handle feel and greater effort by the user to operate or fire the stapler.

The staple leg guide 32 is thus designed preferably to be small and light weight. The guide 32 is preferably a single formed piece of resilient sheet metal. The guide 32 in alternative embodiments may be made entirely from a tough plastic material, or a plastic material with molded-in metal inserts for the fingers 32' where the guide 32 must endure repeated staple impacts.

The preferred embodiment guide 32 has lateral tabs 38 (FIG. 4) that bend outward at an angle so that the part can be snapped into the staple track 28 and retained in the rectangular windows 36 created adjacent to the track feet as seen in FIGS. 2A-2C. The slight taper on the tabs 38 (FIGS. 4(*b*), 5) permits the guide 32 to flex as it is assembled into the track 28 and then to open back into its original shape and fit in the track channel. The tabs 38 also limit the forward movement of the guide 32 and keep it restrained in the track assembly because they are captured within the windows 36 in the track channel.

As seen in FIG. 5, the preferred embodiment staple leg guide 32 includes a pair of spaced apart, fin-like fingers 32' each with a sloped leading edge 48, which fingers 32' protrude out from cutouts 50 at the striker front end of the staple track 28. The fingers 32' guide the interior of the staple legs 34 thereby ensuring a fairly perpendicular entry into the paper stack. As seen in FIGS. 2A-2C, the guide 32 is designed to fit within the channel body of the staple track 28. The pair of fin-like fingers 32' protrude through the cutouts 50 of the track 28 that are formed into the opposed side walls of the track. The respective cutouts 50 are large enough to allow the guide 32 to be biased forward or moved rearward by the downward force of the driven staple 24. The staple pusher 26 also has respective cutouts formed into the side walls at the striker end to allow for clearance with the staples.

As seen in FIG. 3, the guide reset spring 40 is preferably U-shaped 52 so it is small and can be installed inside the track channel with the staple leg guide 32. The guide reset spring 40 is preferably U-shaped to further allow for clearance with the staple pusher spring that biases the pusher 26 to move the staple rack forward. The guide reset spring 40 has bent spring legs 42 that have resilience to urge the staple leg guide 32 forward toward its initial position at the striker end underneath the driven staple 24. The guide reset spring 40 locks into slots cut into the side wall of the staple track 28.

The following empirical performance data substantiate the advantages and benefits of the present invention staple leg guide with a light reset spring when compared to a conventional staple leg guide with a very powerful guide reset spring:

Conventional Stapler A with 120-sheet capacity:

Handle force with a conventional staple leg guide in place: ~21 lbs.

Handle force with staple leg guide removed: ~16 lbs.

Guide force adds ~5 lbs. to handle actuation force.

Force needed to move guide rearward directly out of path of staple: ~11 lbs.

Conventional Stapler B with 210-sheet capacity:

Handle force with a conventional guide: ~8.5 lbs.

Handle force without guide: ~7.0 lbs.

Guide adds ~1.5 lbs. to handle actuation force.

Guide force needed to move rearward: ~15 lbs.

Stapler C with 60-sheet capacity employing present invention guide:

Handle force with present invention guide in place: 12.5 lbs.

Handle force without guide in place: ~12 lbs.

Guide force adds no more than 0.5 lbs. to handle actuation force.

Guide force to move rearward directly: ~2 lbs.

Stapler D with 100-sheet capacity employing present invention guide:

Handle force with present invention guide in place: ~14.5 lbs.

Handle force without guide in place: ~14 lbs.

Guide force adds no more than 0.5 lbs. to handle actuation force.

Guide force to move rearward directly: ~2 lbs.

From the above data, use of the present invention staple leg guide with its light reset spring in Staplers C and D increases handle actuation force by only 4% and 3.6%, respectively. By comparison, using a conventional staple leg guide in Staplers A and B with a powerful guide reset spring increases handle actuation force 31% and 21%, respectively.

Furthermore, the reset force of the staple leg guide pushing forward against the staple or striker for a conventional, standard capacity desktop guide is 11 lbs. and 15 lbs. versus only 2 lbs. for the present invention staple leg guide. The reduction in friction and wasted energy stemming from the reset force going from 11 lbs. and 15 lbs. down to 2 lbs. in the present invention is an astonishing 82% and 87%, respectively. Of course, for larger capacity stapler, the leg guide reset force can be adjusted as needed for about 2 lbs. to 10 lbs. inclusive of all values therebetween and the outer limits, based on in part material selection, size of components, paper stapling capacity, and other engineering characteristics of the reset spring 40.

The staple leg guide used in all stapler models mentioned above move about the same distance, about 0.03 inch. This is the same as the approximate thickness of the staple wire.

In various alternative embodiments, the staple leg guide can rotate out of the way of the staple/striker instead of forward/backward sliding movement. The staple leg guide could be pivotally mounted to the track. The staple leg guide spring could be made for a metal stamping or a compression spring. The staple leg guide "U" shape could be inverted in the stamping direction from how it is formed now.

In further alternative embodiments, the staple leg guide reset spring 40 may be made from resilient plastic. Alternatively, the staple leg guide reset spring can be made of resilient metal wire. Also, the staple leg guide reset spring may be made by a partial cut in the staple guide base metal to create a cantilevered spring arm. One or more conventional coiled or leaf springs may be used as well.

Figure 6:
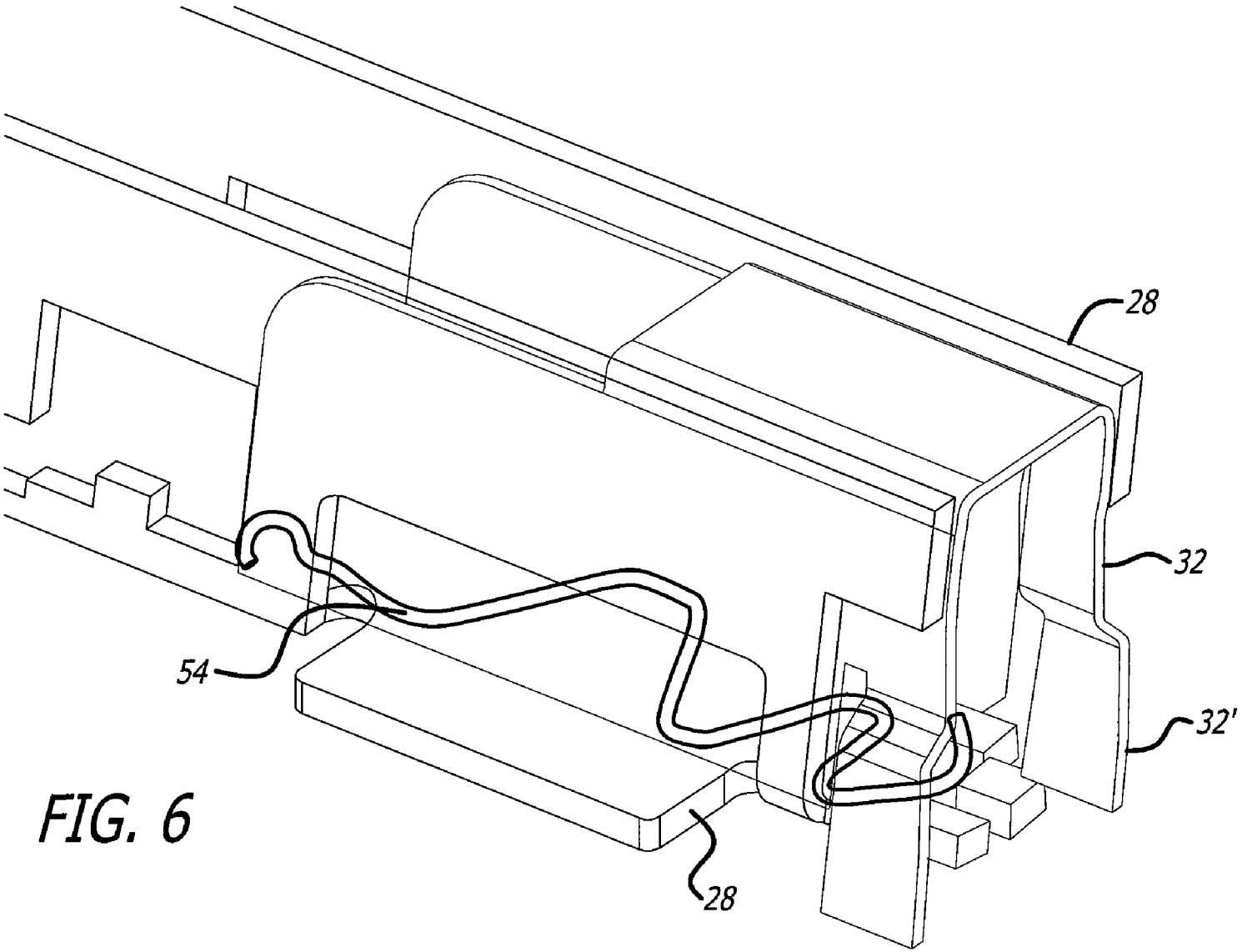
FIGS. 6-8 show an alternative embodiment guide spring made of a resilient wire.
Figure 7:
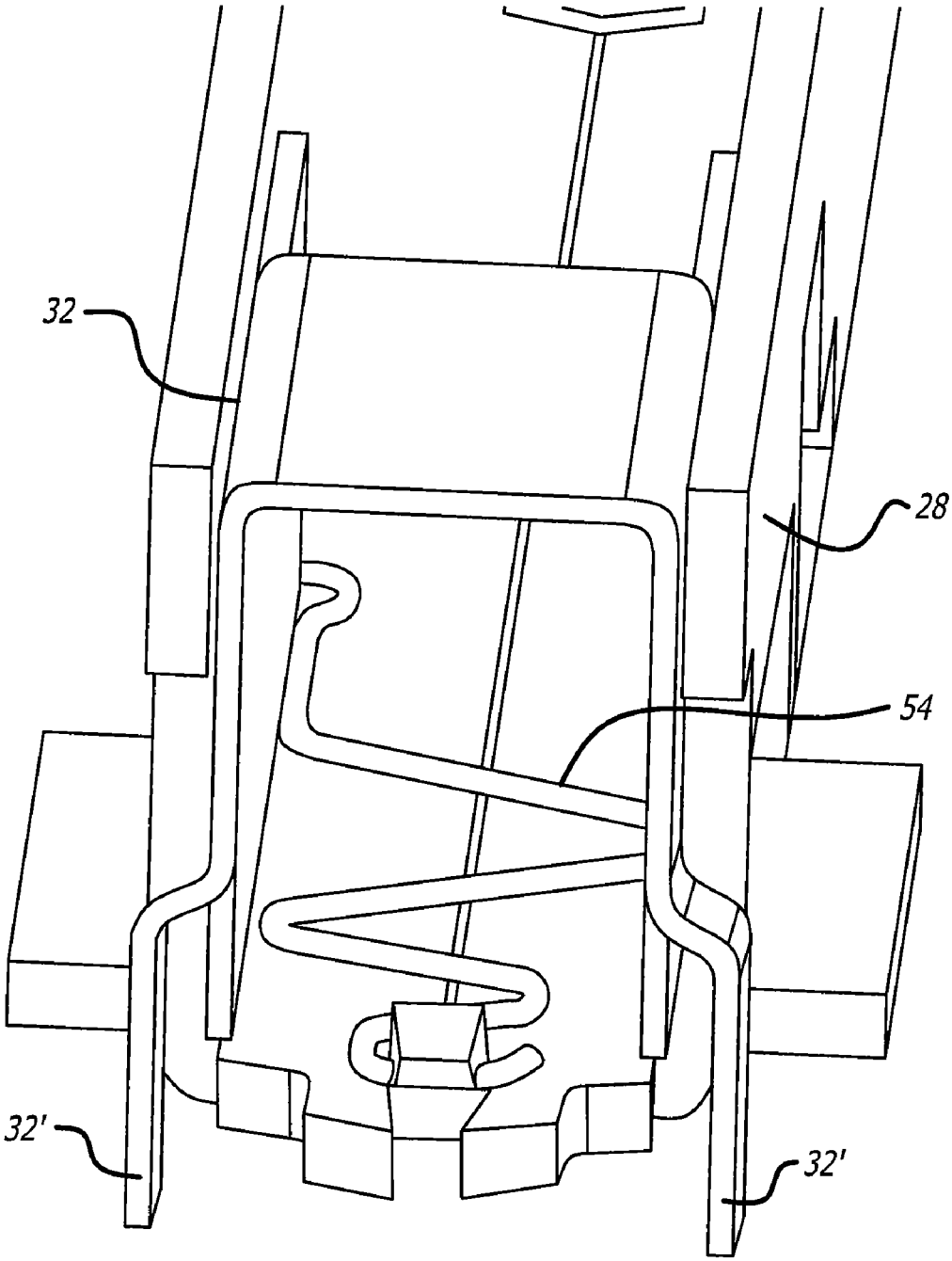
Figure 8:
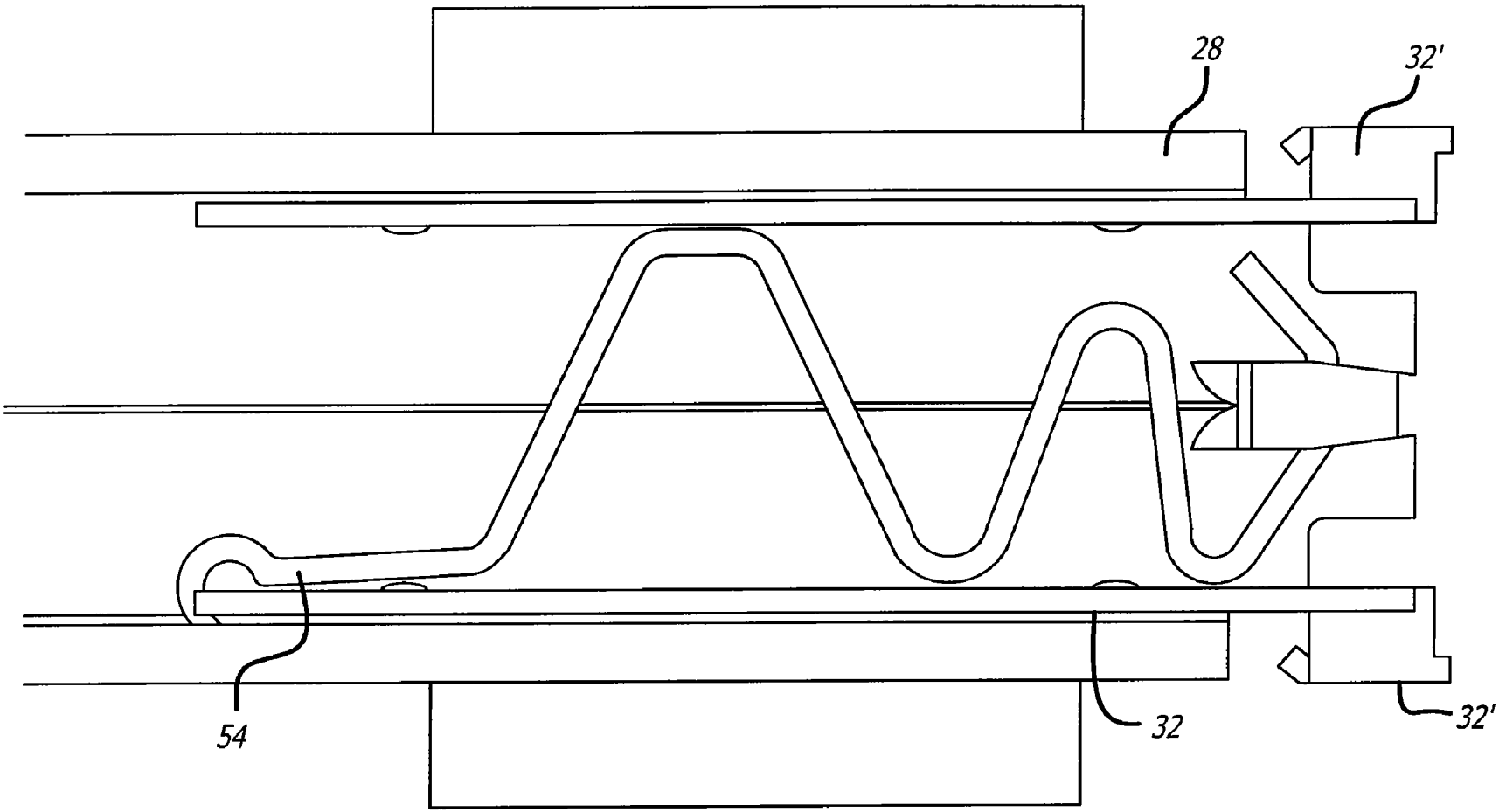

FIGS. 6-8 shows an alternative embodiment staple leg guide reset spring 54 formed out a piece of resilient steel wire that hooks around the staple track 38 at the front and hooks around the staple leg guide 32 at the back. This reset spring 54 stretches as the staple leg guide 32 is pushed back and returns the guide to the forward position as the striker is raised during the initial stages of a staple firing cycle so that the staple leg guide can be located in its proper position to support the staple legs.

Figure 9:
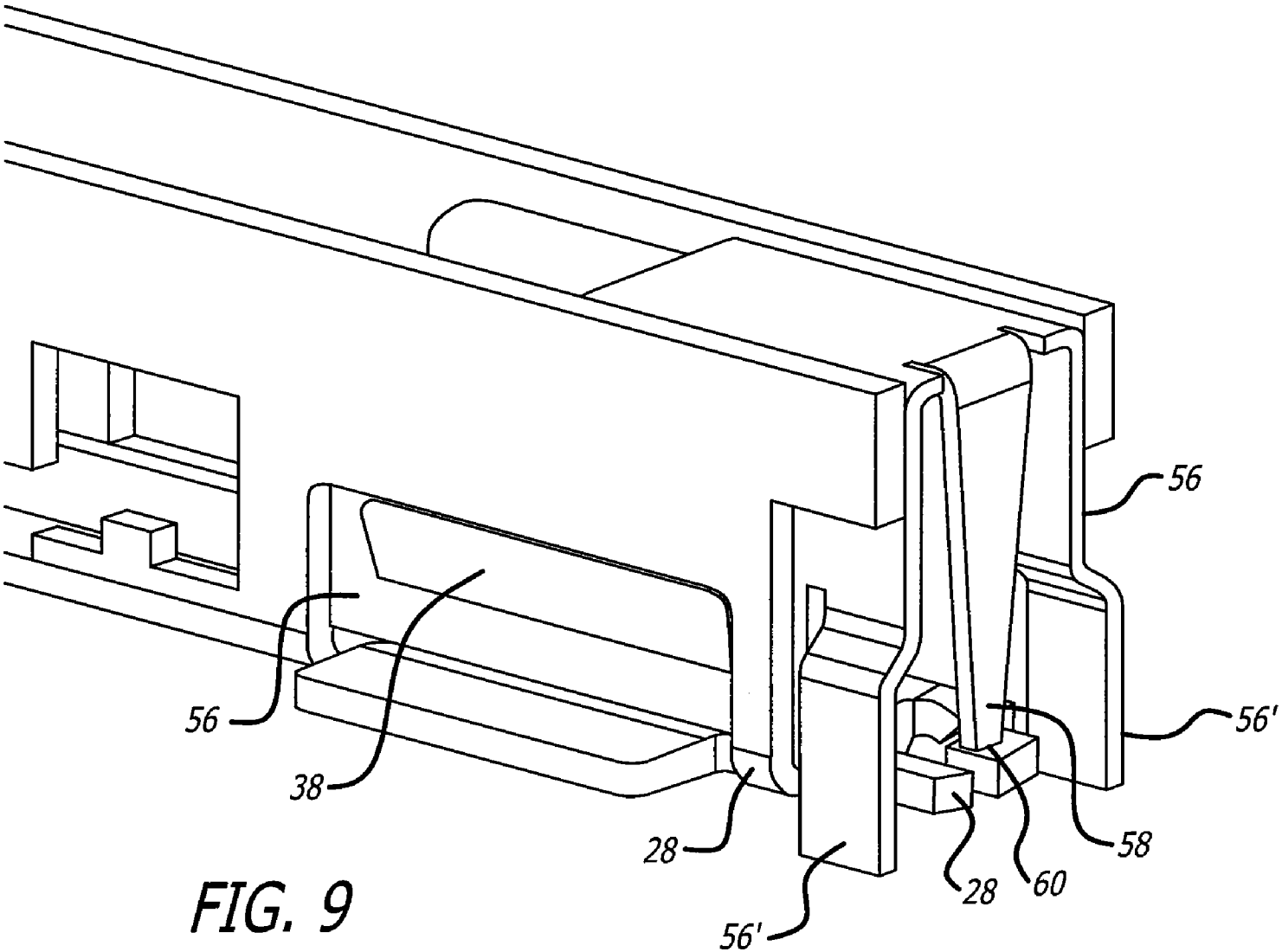
FIGS. 9-10 show an alternative embodiment guide spring that is formed integrally with the guide.

FIG. 9 depicts an alternative embodiment staple leg guide 56 with an integral, cantilevered reset spring arm 58 formed into the part. The spring arm 58 has a preferably trapezoidal plane configuration leading to a narrow distal end 60, and relies on the springback inherent in the base material to create the bias. Other shapes for the spring arm are of course contemplated. This embodiment eliminates an extra component, a discrete reset spring, from the staple leg guide mechanism making it more cost effective and easier to manufacture.

Figure 10:
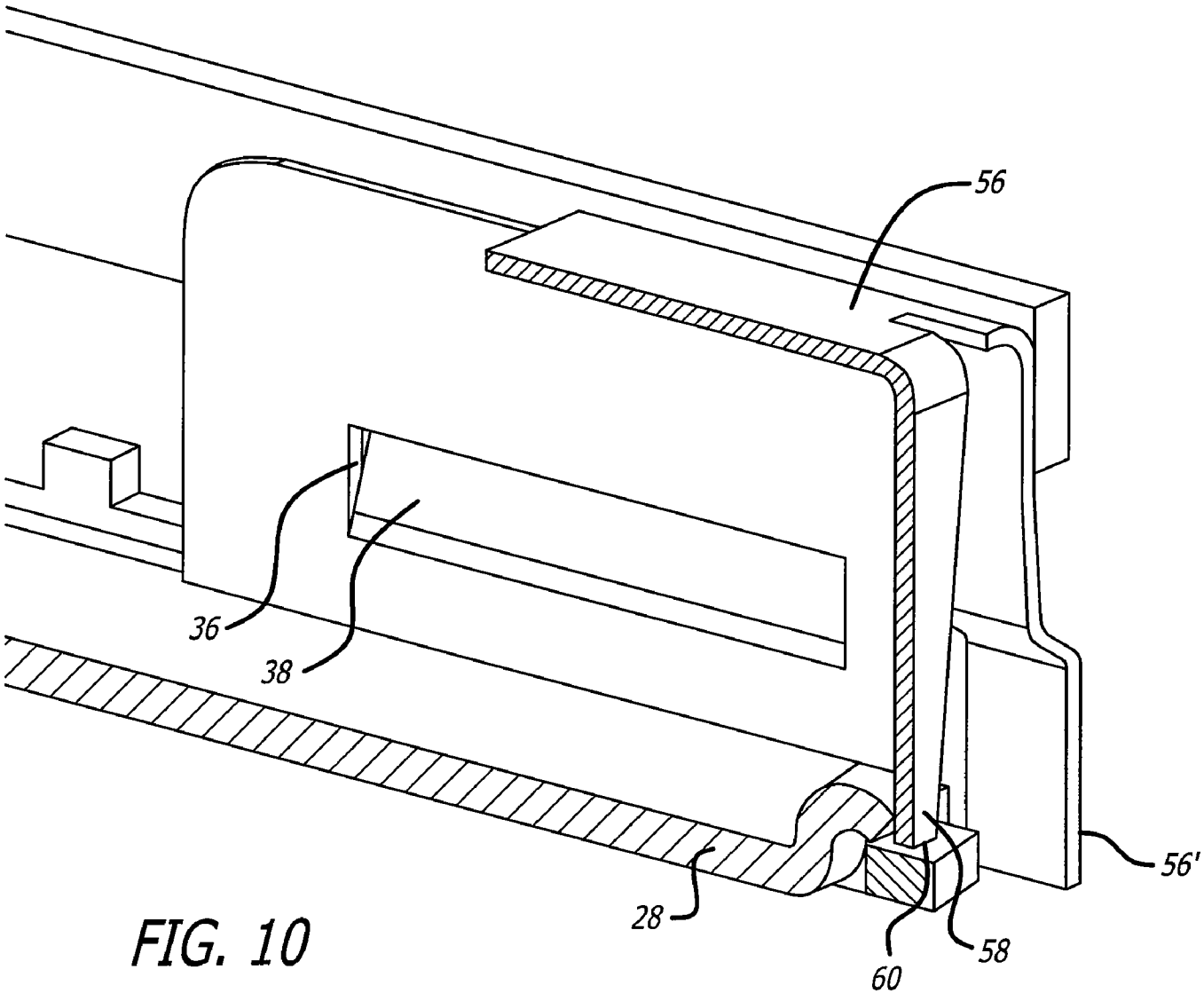
Figure 11:
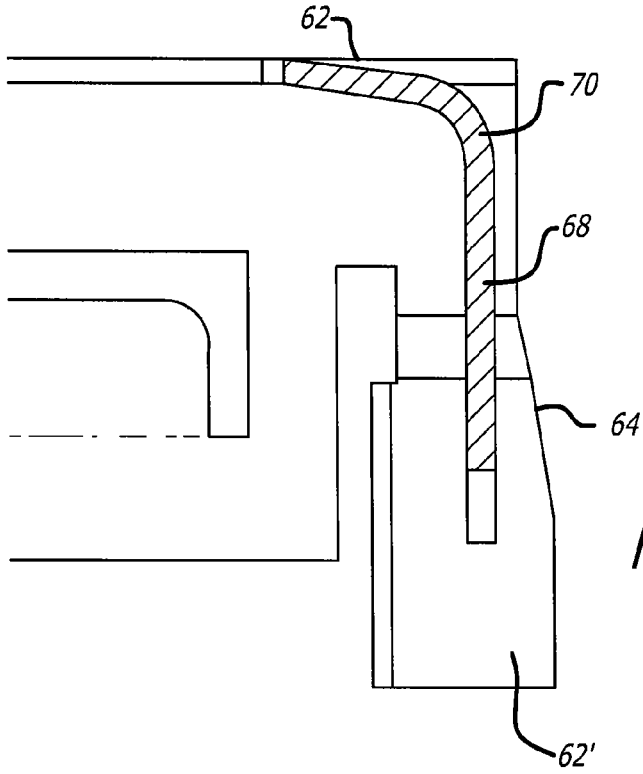
FIGS. 11-12 are a side elevational view and a front perspective view, respectively, of an alternative embodiment of the spring tab.
Figure 12:
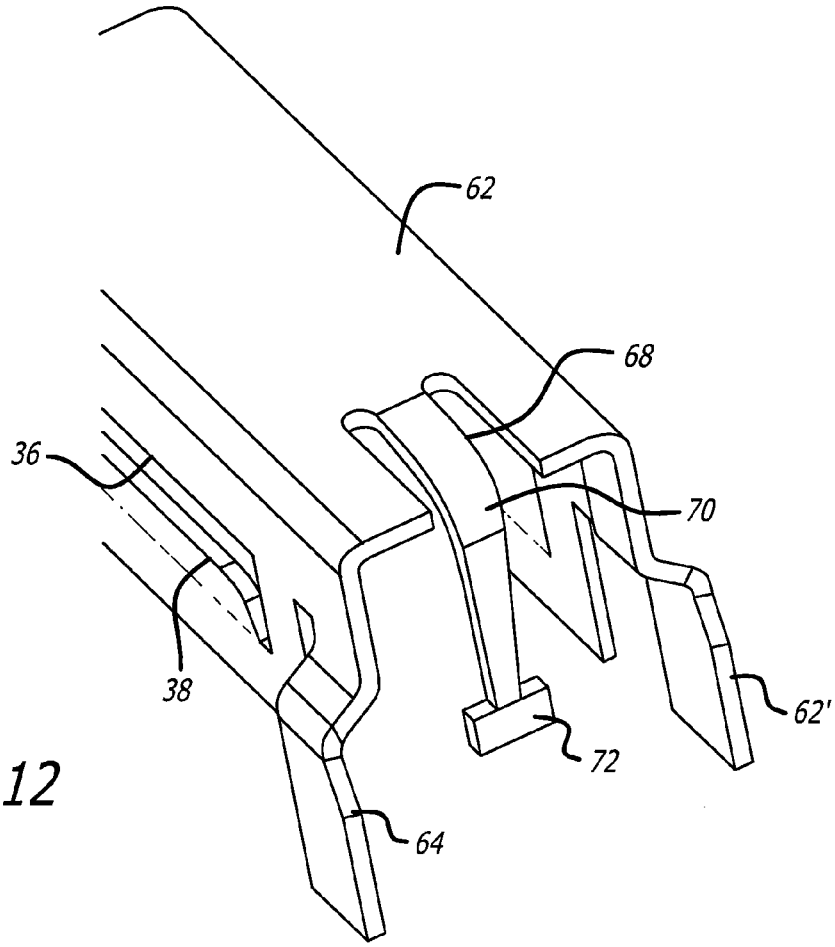
Figure 13:
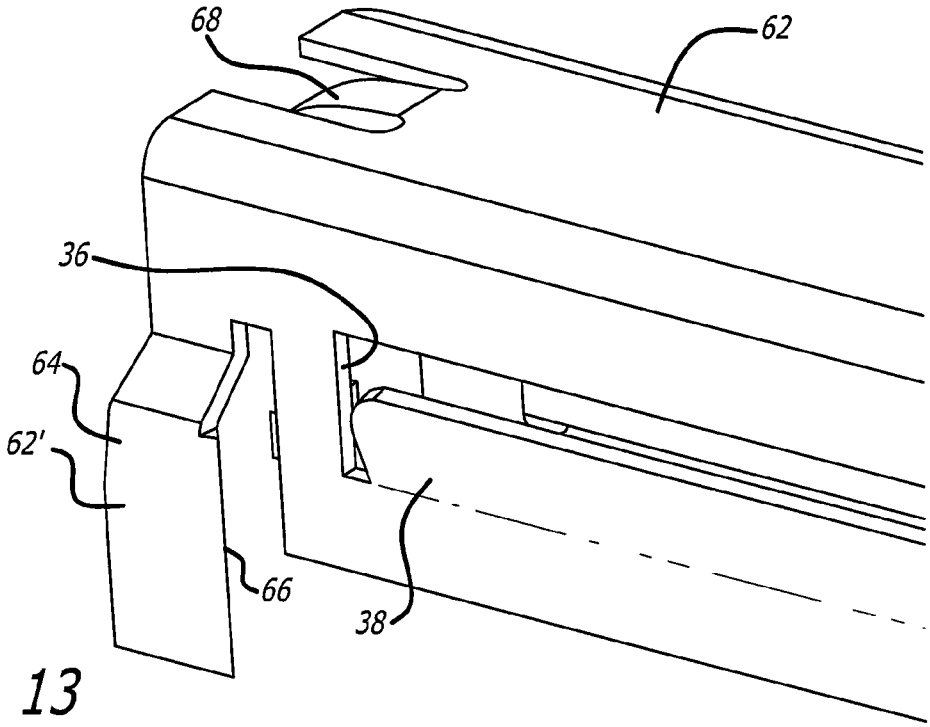
FIGS. 13-14 are a side perspective view and top plan view of an alternative embodiment staple leg guide having a trailing edge with a slight inward bend.
Figure 14:
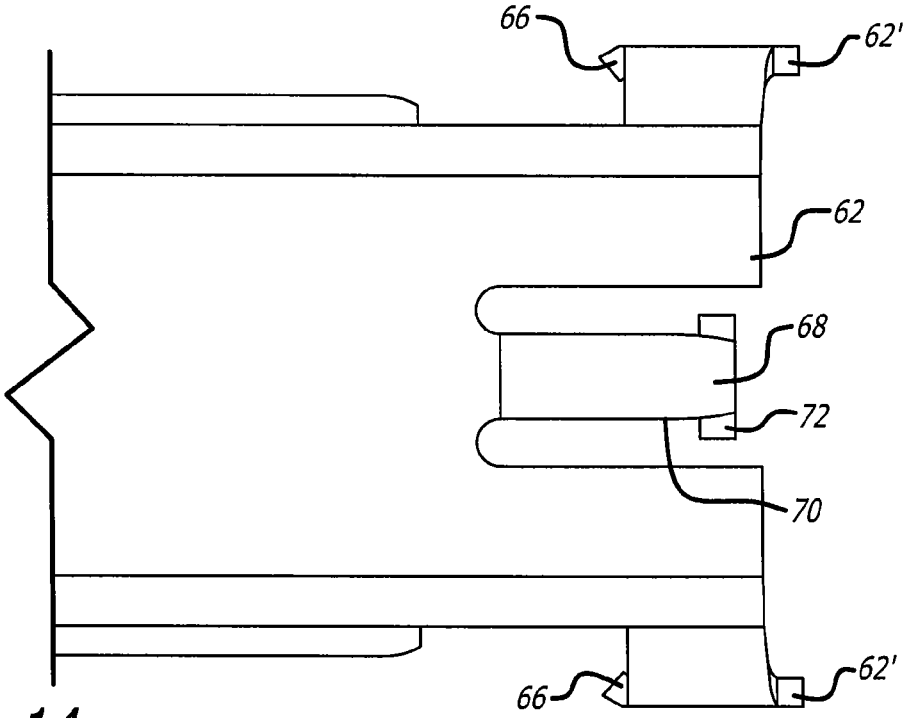

FIG. 10 is a cross-sectional view of the staple leg guide 56 of FIG. 9 cut along its length. As seen in FIGS. 9-10, the spring arm 58 is joined to the staple track 28 such that the leading edge of the fingers 56' of the guide 56 are beneath the staple. As the staple is driven by the striker, the staple legs are guided by the fingers 56' as in the other embodiments. The downward moving staple ultimately pushes on the sloped leading edge of the fingers 56' to force the guide 56 backward away from the front end of the track, which movement bends and energizes the resilient spring arm 58, which has its distal end 60 affixed, assembled, wedged, riveted, or otherwise immobilized to the staple track 28. Once the staple path is cleared of the driven staple, the resilience and bias in the spring arm 58 urges the staple leg guide 56 forward and back to its initial position underneath the next staple in the rack.

FIGS. 11-14 are various views of yet another alternative embodiment staple leg guide 62. The staple leg guide 62 again has the two downward extending fin-like fingers 62' with a polygonal shape. As best seen in the top plan view of FIG. 14, each finger 62' has a sloped leading edge 64 and optionally includes an inward bend 66 at the back edge. This slight inward bend 66 allows the rack of staples to feed forward easily and smoothly, and minimizes the chance that the rack catches on the fingers 62' jamming the feed mechanism.

Furthermore, the overall shape of the integral reset spring arm 68 is slightly different than the FIG. 9-10 embodiment. Specifically, the spring arm 68 in FIGS. 11-14 has the same function as the other embodiment, but is recessed farther toward the top center of the guide 62, and has a gradual 90-degree bend 70. These structures help increase the fatigue life of the spring arm 68 and guide 62. The distal end of the spring arm 68 includes an optional rectangular tab 72 for mounting or assembly to the staple track. The rest of the staple leg guide 62 have the same features as the other embodiments with a window 36 and bent tab 38.

From the foregoing detailed description, it should be evident that there are a number of changes, adaptations and modifications of the present invention that come within the province of those skilled in the art. However, it is intended that all such variations not departing from the spirit of the invention be considered as within the scope thereof except as limited solely by the following claims.

We claim:

1. A staple track for supplying staples from a rack of staples for use in a desktop stapler, comprising:

a U-channel body having a width that matches the approximate width of a staple and a length to support a rack of staples thereon and having a striker end and a back end, and wherein the channel body includes side walls with windows;

a staple pusher disposed on the channel body and biased away from the back end of the channel body toward the striker end to push the staples disposed on the channel body;

a staple leg guide slidably disposed within the channel body and biased toward the striker end, wherein the staple leg guide includes two tabs that extend outside of the channel body through the windows so that the tabs traverse within the windows toward or away from the striker end; and a staple leg guide reset spring biasing the staple leg guide toward the striker end.

2. The staple track of claim 1, wherein the staple leg guide reset spring includes a channel shape with at least one cantilevered, bent leg creating the reset spring force.

3. The staple track of claim 1, wherein the staple leg guide spring includes a polymer.

4. The staple track of claim 1, wherein the staple leg guide includes a pair of downward extending, spaced apart fin-like fingers with a sloped leading edge and a back edge.

5. The staple track of claim 4, wherein each finger includes an inward bend at the back edge.

6. The staple track of claim 1, wherein the staple leg guide reset spring is disposed within the staple track and includes at least one resilient bent leg abutting the staple leg guide.

7. The staple track of claim 4, wherein the staple pusher includes a cutout through which the fingers pass.

8. The staple track of claim 1, wherein a staple leg guide reset spring includes a cantilevered spring arm integral with the staple leg guide and extends forward and downward from the top of the staple leg guide.

9. The staple track of claim 1, wherein the staple leg guide reset spring produces a reset force of about 2 lbs. to 10 lbs.

10. A staple track for supplying staples from a rack of staples for use in a desktop stapler, comprising:

a U-shape channel body having a striker end and a back end, wherein the channel body includes side wall windows;

a staple pusher disposed on the channel body and biased away from the back end of the channel body toward the striker end; and a U-channel shape staple leg guide disposed within the channel body and biased toward the striker end, wherein the staple leg guide includes two tabs that extend through the windows, and two fin-like fingers spaced apart, disposed toward the striker end of the channel body extending downward.

11. The staple track of claim 10, wherein the staple leg guide includes an integral reset spring arm extending downward from the staple leg guide and mounting to the striker end of the channel body.

12. The staple track of claim 10, wherein each fin-like finger includes a sloped leading edge and an inward bending back edge.

13. A staple track for supplying staples from a rack of staples for use in a desktop stapler, comprising:

a U-shape channel body having a striker end and a back end, wherein the channel body includes side wall windows;

a staple pusher slidably disposed on the channel body and biased away from the back end of the channel body toward the striker end; and a staple leg guide disposed within the channel body, wherein the staple leg guide includes two tabs that extend through the windows of the channel body, and two fin-like fingers spaced apart, disposed toward the striker end of the channel body extending downward; and a means for biasing the staple leg guide toward the striker end of the channel body.

14. The staple track of claim 13, wherein the means for biasing includes a wire reset spring attached to the channel body.

15. The staple track of claim 13, wherein the means for biasing includes a U-channel shape body with resilient arched legs engaging the staple leg guide.

16. The staple track of claim 13, wherein the means for biasing generates a biasing force of about 2 lbs. to 10 lbs.

* * * * *